US010369072B2

(12) United States Patent
Herman, Jr. et al.

(10) Patent No.: US 10,369,072 B2
(45) Date of Patent: Aug. 6, 2019

(54) ORTHOTIC DEVICE

(71) Applicant: KINEMATIC VENTURES, LLC, Washington, DC (US)

(72) Inventors: Harry H. Herman, Jr., Washington, DC (US); Henry H. Herman, Washington, DC (US)

(73) Assignee: KINEMATIC VENTURES, LLC, Washington, DC (US)

( * ) Notice: Subject to any disclaimer, the term of this patent is extended or adjusted under 35 U.S.C. 154(b) by 0 days.

(21) Appl. No.: 15/864,107

(22) Filed: Jan. 8, 2018

(65) Prior Publication Data

US 2018/0125739 A1 May 10, 2018

Related U.S. Application Data

(63) Continuation of application No. PCT/US2016/041465, filed on Jul. 8, 2016.
(Continued)

(51) Int. Cl.
*A61H 3/02* (2006.01)
*A45B 1/00* (2006.01)
(Continued)

(52) U.S. Cl.
CPC ..... *A61H 3/02* (2013.01); *A45B 1/00* (2013.01); *A45B 3/00* (2013.01); *A45B 7/005* (2013.01); *A45B 9/04* (2013.01); *A45B 2009/007* (2013.01); *A61H 2003/006* (2013.01); *A61H 2003/007* (2013.01); *A61H 2003/0216* (2013.01); *A61H 2201/018* (2013.01); *A61H 2201/0173* (2013.01);
(Continued)

(58) Field of Classification Search
CPC ..... A61H 3/02; A61H 2003/0216
See application file for complete search history.

(56) References Cited

U.S. PATENT DOCUMENTS 5,113,887 A * 5/1992 Herman, Jr. ..... A61H 3/02 135/68
5,181,931 A 1/1993 Van De Veen
(Continued)

OTHER PUBLICATIONS

International Preliminary Report on Patentability dated Jan. 9, 2018, in related international application No. PCT/US2016/041465.

*Primary Examiner* — Noah Chandler Hawk
(74) *Attorney, Agent, or Firm* — Dickinson Wright PLLC

(57) ABSTRACT

An orthotic device for assisting a user in walking includes an underarm support assembly configured to support a user's weight without damage to their nerves, and upright support pivotally connected to the underarm support assembly and a ground engaging assembly pivotally connected to the upright support. In one embodiment, the underarm support assembly is spring biased relative to the upright support to bias the upright support to an orientation substantially perpendicular to a longitudinal dimension of the underarm support. The ground engaging assembly is also biased to bias the ground engaging assembly to a position perpendicular to the longitudinal axis of the upright support while allowing the ground engaging assembly to pivot about an axis perpendicular to the longitudinal dimension of the upright support and about an axis parallel to the longitudinal dimension of the upright support.

7 Claims, 9 Drawing Sheets

Related U.S. Application Data

(60) Provisional application No. 62/190,496, filed on Jul. 9, 2015.

(51) Int. Cl.

| | |
|---|---|
| ***A45B 3/00*** | (2006.01) |
| ***A45B 7/00*** | (2006.01) |
| ***A45B 9/04*** | (2006.01) |
| *A45B 9/00* | (2006.01) |
| *A61H 3/00* | (2006.01) |

(52) U.S. Cl.

CPC ..... *A61H 2201/0192* (2013.01); *A61H 2201/1676* (2013.01); *A61H 2201/5058* (2013.01); *A61H 2201/5097* (2013.01); *A61H 2230/06* (2013.01); *A61H 2230/50* (2013.01)

(56) References Cited

U.S. PATENT DOCUMENTS

| | | | | |
|---|---|---|---|---|
| 5,348,035 | A | 9/1994 | Porter | |
| 5,640,986 | A * | 6/1997 | Herman | A61H 3/02 135/68 |
| 5,862,824 | A * | 1/1999 | Herman | A61H 3/02 135/68 |
| 6,164,305 | A | 12/2000 | Herman | |
| 7,581,556 | B2 * | 9/2009 | Haslach, Jr. | A45B 1/00 135/77 |
| 7,673,640 | B2 * | 3/2010 | Haslach, Jr. | A61H 3/02 135/68 |
| 8,551,184 | B1 | 10/2013 | Herr | |
| 2012/0167933 | A1 | 7/2012 | Vegvary | |

* cited by examiner

ORTHOTIC DEVICE

This application claims priority to PCT/US2016/041465 filed Jul. 8, 2016 which claims priority to U.S. Provisional application No. 62/190,496 filed Jul. 9, 2015, and are hereby incorporated by reference in their entirety.

FIELD OF THE INVENTION

The present invention is directed to a walking aid with an underarm orthotic device for carrying their weight in assisting a person to walk. The invention is particularly directed to a walking aid having a support connected to a ground engaging base where the support is able to pivot with respect to the plane of the base in more than one direction.

BACKGROUND OF THE INVENTION

Mobility is essential to functioning independently, particularly in today's highly mobile society. Thus, mobility is of constant concern and necessity to those individuals who are incapable of walking or who are limited in their ability to walk normally.

Crutches and canes require the user to balance on the bottom tip of the support which contacts the walking surface. However, the rubber-coated tip of the crutch has a limited cross-sectional area that can slip on rocks, loose gravel, ice and wet or uneven surfaces. This is also true for canes, walkers and walking sticks.

Underarm crutches are uncomfortable and can be hazardous to the user. Crutches do not ergonomically fit people in a satisfactory manner. To prevent interference with the arms and body, conventional crutches must be used at an angle relative to the direction of travel with the base tip away from the user's feet. By FDA definition a crutch user may not place their weight on their underarms. Carrying user's weight can damage the radial and axial nerves causing "crutch palsy." The underarm support transfers the user's weight against the axillary and radial nerves causing "crutch palsy." Conventional crutches cannot be correctly used in the vertical plane parallel to the user's body and they must be used so that the longitudinal axis thereof is not at a right angle to the walking surface. The angle at which the tip of the crutch contacts the ground not only from forward to rear, but also laterally, does not lend itself to proper traction. This lateral angle causes the fixed upper end of the crutch to place force against the upper ribs under the arms and the nerves in the axilla and in particular the radial nerve which can cause discomfort and injury. The forward and rear motion of the crutch and the resulting underarm motion cause abrasion by the upper end movement of a pressure point from a forward point to a rearward point under the arm as the crutches pivot relative to the ground from their forward to their rearward position. Thus, the practice is to place padding on the upper end of the crutch to attempt to prevent injury to the user.

Proper use of crutches requires that no weight be placed on the underarm. The hands and arms are supposed to carry all the weight. Experience has shown that most users do not have sufficient arm and hand strength to accomplish this and often improperly use the crutches resulting in accidents and injuries.

Crutch mobility under normal use is dependent upon one or both legs of the user leaving the ground and swinging forward like a pendulum to the forward point where it contacts the walking surface. The foot in contact with the walking surface then acts as a fulcrum while the crutches move off the surface from the rear position to the forward position. Crutches therefore operate on the basis that the top of the crutch moves in the form of an arc with the apex in the vertical or upright position. This means that the user of a crutch must be raised then lowered by the use of the underarm rest. The effort required to move forward on a crutch is increased due to the need to have a force or momentum in the action sufficient to lift the user during each forward step of the crutch. This lifting force also places cyclic forces upward on the user's underarm and shoulders. When the user drops in the forward position, their feet or foot impacts the ground and can cause injury and discomfort especially to those with additional functional limitations or the elderly or frail.

It is therefore desirable to provide devices including a crutch for assisting the mobility of injured or handicapped individuals which provide a stable base structure that is ergonomically correct, does not require much instruction to use and minimizes the likelihood of slippage on wet or icy surfaces or that an uneven or rough walking surface will inhibit the stability of the crutch structure and thereby the mobility of the individual. It is desirable to provide a crutch-like structure that minimizes the discomfort and possible injury to the individual's hand, feet, arm or underarm during use.

While these prior devices have generally been suitable for their intended purpose, there is a continuing need in the industry for an improved mounting assembly.

SUMMARY OF THE INVENTION

The present invention is directed to a walking aid for assisting in the mobility of injured or otherwise handicapped individuals by providing a stable base structure that remains flat on the ground surface during the motion of the individual relative to the ground. The invention is further directed to a walking device where the underarm support remains in a fixed position relative to the user while the upright support pivots in a forward and rearward direction relative to the user.

One object of the invention is to provide a device for maintaining the underarm support parallel to the ground. Unlike a crutch support, the underarm support of the invention does not move relative to the underarm so the user's weight is evenly distributed on the underarm support through the movement cycle. In the condition the user's weight is evenly distributed over the entire underarm elimination the concentration force caused by conventional crutches so that there is minimal abrasive or rubbing action and where the device is ergonometric and suitable to the conditions of the user.

One embodiment of the present invention provides a weight bearing orthotic underarm support for contact with the user's body that distributes uniform weight (force) over the underarm area with no force concentrations.

One embodiment of the invention provides an orthotic device having an underarm support having a shape and configuration for fitting snugly to the underarm of the user to inhibit movement during use between the underarm support and the user. The underarm support assembly has a rigid frame with sufficient padding and cushioning to support the weight of the user without discomfort. The underarm support assembly is pivotally connected to a vertical support whereby the underarm support assembly is able to pivot in a forward and rearward direction relative to the user. The vertical support is biased to an upright, vertical position relative to a horizontal orientation of the underarm support assembly while allowing the vertical support to pivot forward and rearward relative to the underarm support assembly.

In one embodiment, the underarm support assembly has a substantially U-shaped frame with padding for supporting the weight of the user. The frame is coupled to the base to form an integral unit. The base is pivotally coupled to the vertical support to allow the vertical support to pivot in a longitudinal dimension of the base. The vertical support pivots relative to the base so that the based and underarm support do not move relative to the user when the vertical support pivots forward and backward. In one embodiment, springs are provided to extend between the vertical support and the opposite ends of the base of the frame assembly to allow pivoting movement of the vertical support relative to the base while biasing the vertical support to an upright vertical position substantially perpendicular to the longitudinal dimension of the base.

The vertical support includes a hand grip that can be adjusted along the longitudinal length of the vertical support and around the perimeter of the vertical support. The adjustable hand grip provides variable adjustment of the handgrip relative to the vertical support and the underarm support assembly to provide increased ergonomic comfort to the user.

In one embodiment of the invention, the vertical support includes a ground engaging base assembly that is pivotally coupled to the vertical support. The ground engaging base assembly has a ground engaging surface with a dimension and configuration to provide support and skid resistance during use. The ground engaging base assembly has a longitudinal dimension that normally extends substantially parallel to the longitudinal dimension of the base of the underarm support assembly or at an angle selected by the user.

The ground engaging base assembly may be biased relative to the vertical upright support to maintain a substantially perpendicular orientation with respect to the longitudinal axial dimension of the vertical support. In one embodiment, at least one and typically two springs extend between the vertical upright support and the opposite longitudinal ends of the ground engaging base to bias the ground engaging base to a rest position while allowing the ground engaging base to pivot about an axis perpendicular to the longitudinal axis of the vertical support and rotate about an axis parallel to the longitudinal axis of the vertical support. The springs provide a spring balancing mechanism to bias the ground engaging assembly to a selected position and angle relative to the upright support.

A further object of the invention is to provide a cane having a forearm cuff adapter that can be coupled to the cane. The cane can have a ground engaging base that can pivot about an axis perpendicular to the longitudinal axis of the cane and an axis parallel to the longitudinal axis of the cane. The cane can have an angled portion extending at an incline relative to the vertical portion of the cane and a handgrip extending from the angled portion substantially perpendicular to the longitudinal axis of the vertical portion of the cane. A forearm cuff assembly is coupled to the inclined portion of the cane for engaging the forearm of the user enabling the user to place some weight on the forearm support.

A further object of the invention is to provide an orthotic device having two parallel vertical supports extending between the underarm support assembly and the ground engaging assembly whereby the underarm support and the ground engaging assembly remain substantially parallel to each other during pivoting movement of the vertical supports relative to the underarm support assembly. The vertical supports are pivotally connected to the underarm support assembly and to the ground engaging support to pivot forward and rearward relative to the direction of travel by the user. A cross member extends between the vertical supports and is oriented between the underarm support assembly and a ground engaging assembly. The spring or other biasing member extends between the cross member and the ground engaging support to bias the ground engaging support to a selected position, such as a position substantially perpendicular to the longitudinal axis of the vertical supports. A bracket having a first longitudinal end is pivotally connected to the ground engaging support to pivot about a pivot axis relative to the ground engaging support. The spring is connected to the bracket at a location spaced from the pivot axis of the bracket. The bracket is able to pivot about the pivot axis away from the ground engaging support as the vertical supports are moved in a forward direction relative to the user with minimal spring tension. The bracket is able to pivot so that a second longitudinal end of the bracket engages the ground engaging support when the ground engaging support is rearward of the user to provide increased tension to pivot the ground engaging support to a position substantially perpendicular to the longitudinal axis of the vertical supports.

The various features of the invention include an orthotic device where the upright support member is able to rotate about a vertical axis with respect to the ground engaging base. In one embodiment, the orthotic device can have a hand grip that is able to rotate relative to the upright support where the upright support is rotationally fixed relative to the ground engaging base. The result is a walking aid having a ground engaging base that remains flat on the ground while the support structure can rotate relative to the ground engaging base to provide additional comfort to the user.

A further feature of the invention is to provide a walking aid or orthotic device having a spring balancing system that is able to reduce the energy expenditure by about 25% compared to conventional crutches. The energy reduction is provided by the spring system where the spring tension is reduced during the forward movement of the device relative to the user and the spring tension pulls the user forward during the sequence of movements by the user. The spring balancing system increases during the last portion of movement in a sequence of movements during walking so that the spring system no longer pulls the user forward.

Another feature of the invention is to provide a forearm cuff having a support for receiving the user's weight oriented at an angle of about 20 degrees relative to the main support structure to allow the user to apply weight to the forearm rather than directly to the hands and shoulder.

The orthotic device of the invention can be used with various assistance devices without interfering with the operation or function of the device. In one embodiment, the orthotic device can include a step counter to count the number of steps taken by the user.

The various features and advantages of the invention can be obtained by providing an orthotic walking device comprising a support assembly having a shape and configuration for supporting the weight of a user, an upright support member connected to the support assembly, and a ground engaging assembly coupled to the upright support. The upright support is pivotally connected to the ground engaging assembly to pivot along an axis substantially perpendicular to a longitudinal dimension of said ground engaging assembly and pivot about an axis parallel to a longitudinal axis of the ground engaging assembly.

The various objects, advantages and salient features of the invention will become apparent from the annexed drawings and detailed description of the invention which form part of the original disclosure.

BRIEF DESCRIPTION OF THE DRAWINGS

The following is a brief description of the drawings, in which.

DETAILED DESCRIPTION OF THE INVENTION

Figure 1:
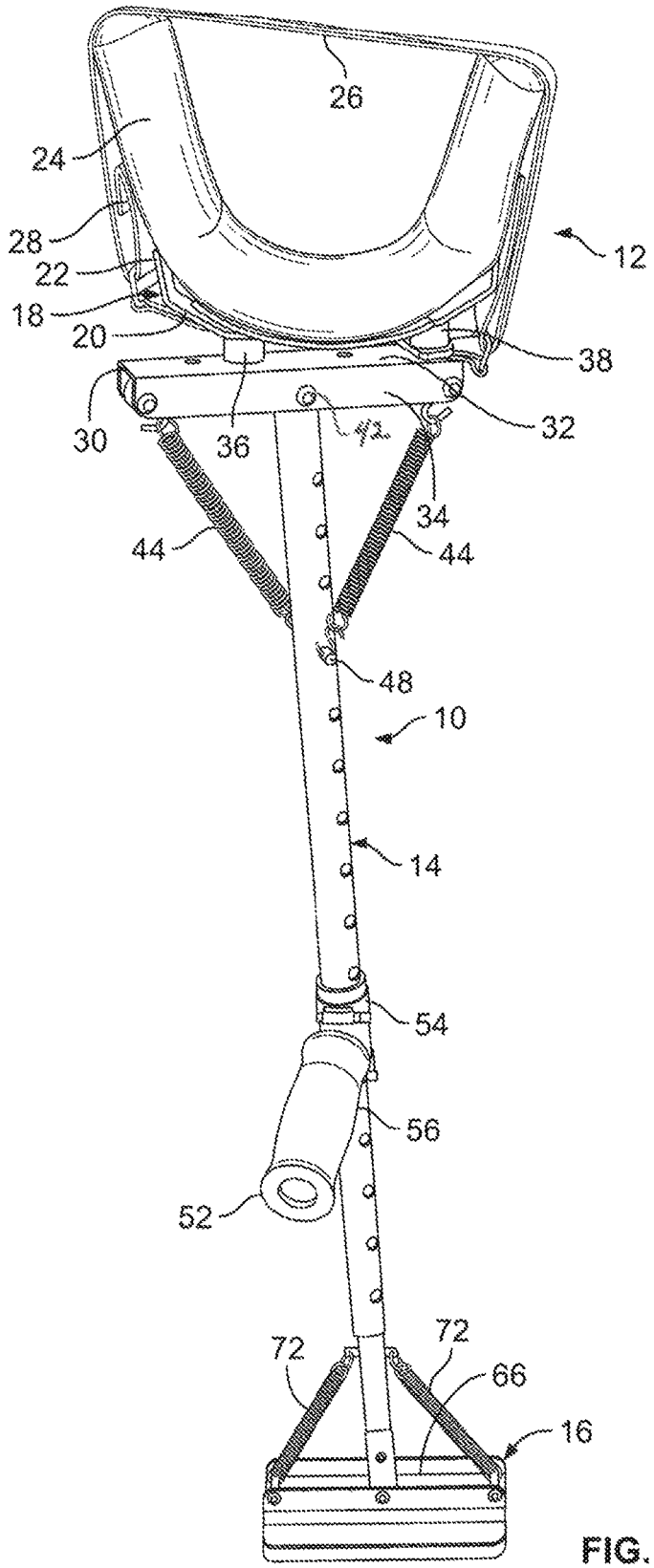
FIG. 1 is a perspective view of the orthotic device in one embodiment of the invention.

The present invention is directed to an orthotic device to assist the user in walking. The invention is further directed to an orthotic device that is able to support the weight of the user without injuring the user's underarm nerves.

In one embodiment of the invention shown in FIGS. 1 to 9, the orthotic device 10 includes an underarm support assembly 12, and an upright support 14, and a ground engaging assembly 16.

The underarm support assembly 12 has a shape and dimension to engage the underarm of the user while substantially preventing or reducing movement of the underarm support assembly 12 with respect to the underarm of the user. In this manner, the underarm support assembly 12 preferably remains stationary relative to the underarm of the user. The underarm support assembly has a longitudinal dimension to extend through the underarm of the user to provide support for the user.

The underarm support assembly 12 has a frame 18 to provide a sufficiently rigid structure to support the weight of the user. In the embodiment shown, the frame 18 has a substantially U-shape with a bottom portion 20 and upright portions 22 that extend an upward direction relative to the bottom portion 20 a distance and at an angle to extend along the front and rear of the shoulder of the user. A cushion or padding 24 is provided on the frame 18 to distribute the user's weight along the frame without applying excessive pressure to one or more points of the underarm of the user.

A harness or strap 26 is attached to the frame 18 to extend between the distal ends of the upright side portions 22 of the frame to extend over the top of the shoulder of the user. The strap 26 includes a buckle 28 or other tensioning adjustment mechanism, such as hook and loops fasteners, to provide a secure fit to the user. During use, the underarm support assembly 12 is positioned in the underarm of the user and the strap 26 extends over the top of the shoulder of the user to securely position the underarm support assembly and inhibit, minimize or prevent movement of the underarm support assembly relative to the patient during use.

As shown in FIG. 1, the frame 18 of the underarm support 12 is connected to a base 30. In one embodiment, the base 30 has a longitudinal dimension complementing the longitudinal dimension of the frame 18. In the embodiment shown, the base 30 has a substantially U-shape with a top face 32 and opposite side faces 34 that extend in a substantially downward direction relative to the device to form an open channel on the bottom side. The frame 18 is coupled to the top face 32 of the base 30 to provide a substantially rigid assembly during use. In one embodiment, the frame 18 is fixed to the top face 32 of the base 30 so that the position of the base 30 is fixed relative to the position of the frame 18.

Figure 5:
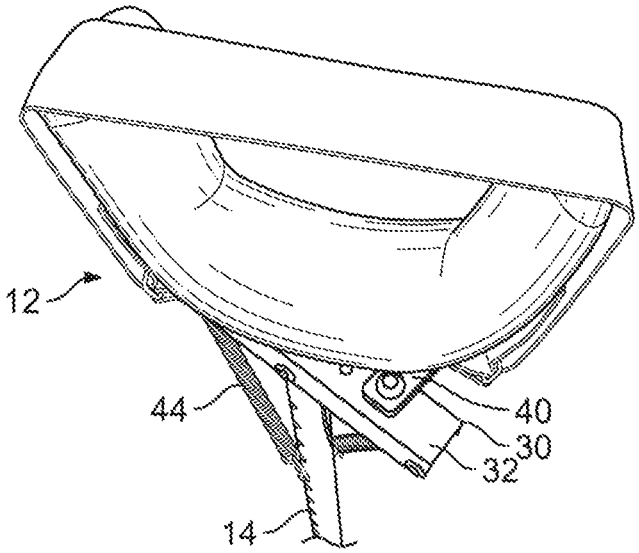
FIG. 5 is a perspective view of the orthotic underarm support assembly showing that the frame position angle can be adjusted relative to the base of the underarm support assembly to accommodate conditions and body structure of the user.
Figure 6:
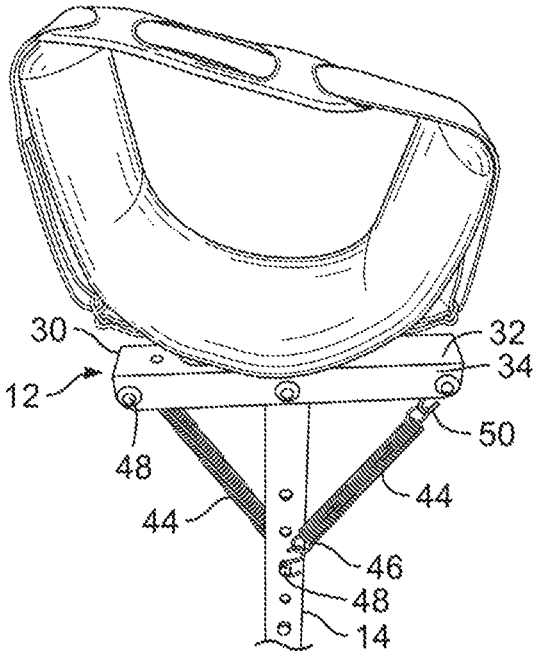
FIG. 6 is a perspective view of the underarm support assembly in a fixed embodiment.

In one embodiment shown in FIG. 5, the frame 18 of the underarm support assembly 16 is coupled to the base 30 whereby the position and angle of the frame 18 can be adjusted relative to the base 30. The base 30 includes at least one coupling and typically a pair of couplings for connecting the base 30 to the frame 18. A first coupling 36 extends between the base 30 and the frame 18 to allow pivoting movement of the frame 18 relative to the base 30 about a vertical axis. Preferably the pivot axis is oriented at the rear end of the underarm support assembly relative to the user. A second coupling 38 can include an adjustment plate 40 having one end connected to the base 30 and the opposite end connected to the frame 18. The adjustment plate 40 allows adjustment of the angle between the longitudinal dimension of the frame 18 and the longitudinal dimension of the base 30 as shown FIG. 5. The adjustment mechanism in the embodiment shown is an adjustment plate extending transversely between the longitudinal ends of the base 30 and the frame 18. The adjustment mechanism can be slot formed in the adjustment plate 40 that receives a screw extending from the frame 18 for sliding within the slot to selected position. Other adjustment mechanisms can be used such as the adjustment mechanism disclosed in U.S. Pat. No. 5,862,824, which is hereby incorporated by reference in its entirety.

The base 30 is pivotally connected to the upright support 14 about an axis defined by the pivot pin 42. The pivot pin 42 extends between the side faces 34 of the base 30 and through an aperture in the upright support 14. The upright support 14 is retained within the channel defined by the U-shaped base 30 to pivot in a longitudinal direction relative to the longitudinal dimension of the base 30. In a preferred embodiment, the upright support 14 pivots along an axis perpendicular to the longitudinal dimension of the base 30 without lateral movement relative to the base and without rotational movement relative to the longitudinal dimension of the base 30. In the embodiment shown, the pivot axis is oriented at the center or midpoint of the base 30. The adjustment assembly of the underarm support assembly allows the underarm support to be adjusted to a selected position to provide comfort to the user by aligning the underarm support with the underarm or axillary of the user while the ground engaging base is aligned with the direction of travel of the user.

Figure 2:
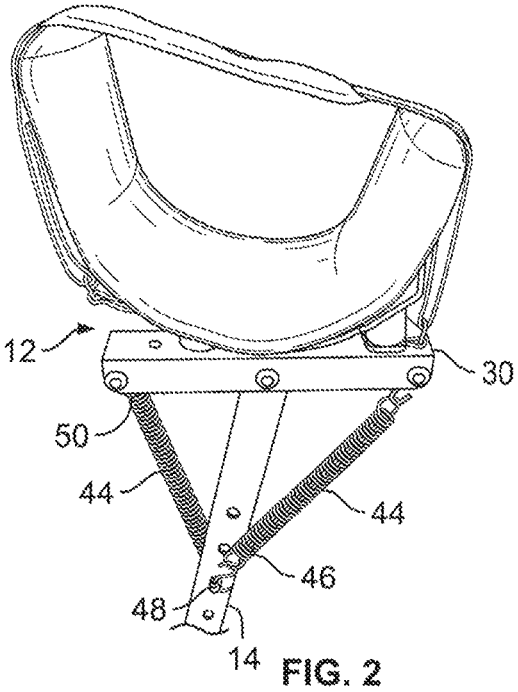
FIG. 2 is a side view of the orthotic underarm support assembly of FIG. 1 where the vertical support is pivoted rearward relative to the user.
Figure 3:
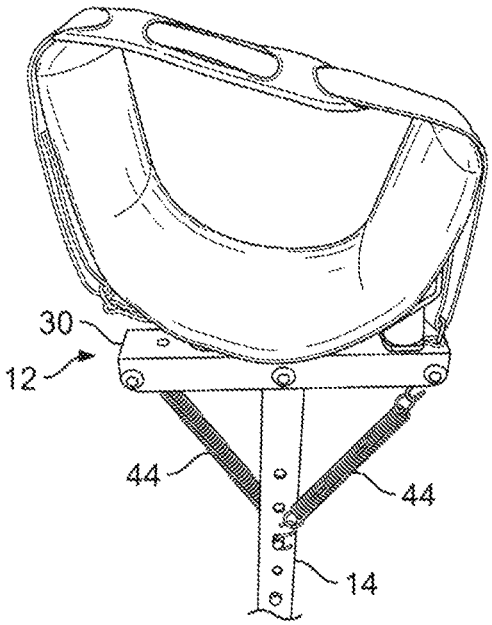
FIG. 3 is a side view of the orthotic underarm support assembly of FIG. 1 showing the vertical support position substantially perpendicular to the longitudinal dimension of the underarm support.
Figure 4:
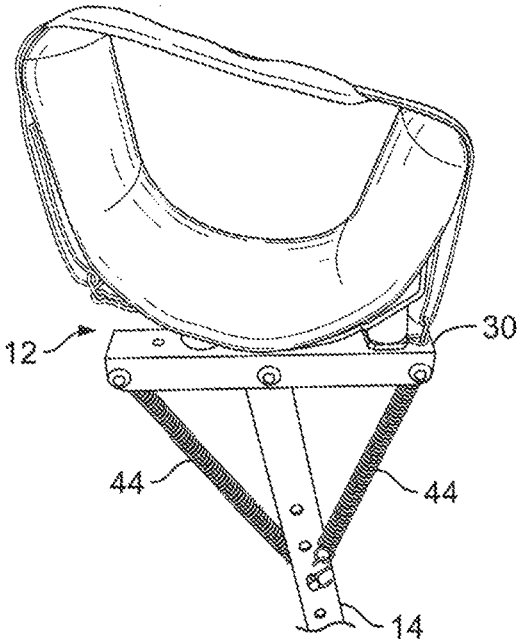
FIG. 4 is a side view of the orthotic underarm support assembly where the vertical support is pivoted in the forward direction relative to the user.

The upright support 14 is preferably biased relative to the base 30 to retain the upright support 14 in an orientation substantially perpendicular to the longitudinal dimension of the base 30 in a rest position. In the embodiment shown, the biasing mechanism includes springs 44 that extend between the upright support 14 and the respective longitudinal end of the base 30. Referring to FIGS. 2-4 the springs 44 provide a balanced system to position the underarm support assembly in a predetermined position relative to the upright support assembly. The springs 44 have a first end 46 connected to the upright support 14 by a pin 48 spaced from the base 30 and have a second end 50 connected to a respective longitudinal end of the base 30. In one embodiment, the springs 44 are substantially the same and provide a uniform tension between the opposite ends of the base 30 to bias the base 30 to a position substantially perpendicular to the longitudinal axis of the upright support 14. In other embodiments, the springs 44 can be mounted in different locations along the upright support 14 and can have different lengths and tensions depending on the intended use. The ends of the springs can be connected to the base 30 and the support 14 by hooks that are connected to the screw or pin coupled to the base 30 and support 14.

The upright support 14 in the embodiment of FIGS. 1 to 9 includes a single tubular member. The upright support 14 can include various sections to adjust the length of the upright support as known in the art. Various mechanisms can be used to adjust the length such as telescoping tubular sections with suitable locking mechanism such as a spring biased buttons.

A hand grip 52 shown in FIG. 1 is coupled to the upright support 14 for gripping by the user. The handgrip in the embodiment shown includes a bracket 54 that surrounds the upright support 14 with suitable adjustment and tightening mechanism to adjust the position of the handgrip along the longitudinal length of the upright support 14 to a suitable location to provide comfort to the user. The bracket 54 is also adjustable to allow rotation of the handgrip 52 relative to the longitudinal axis of the vertical support so that the longitudinal dimension of the handgrip 52 can be selectively adjusted relative to the longitudinal dimension of the underarm support assembly 12. The bracket can be in the form of a ring to surround the support 14 where the ring includes a threaded screw that be tightened to clamp the ring in a fixed position on the support 14.

Figure 7:
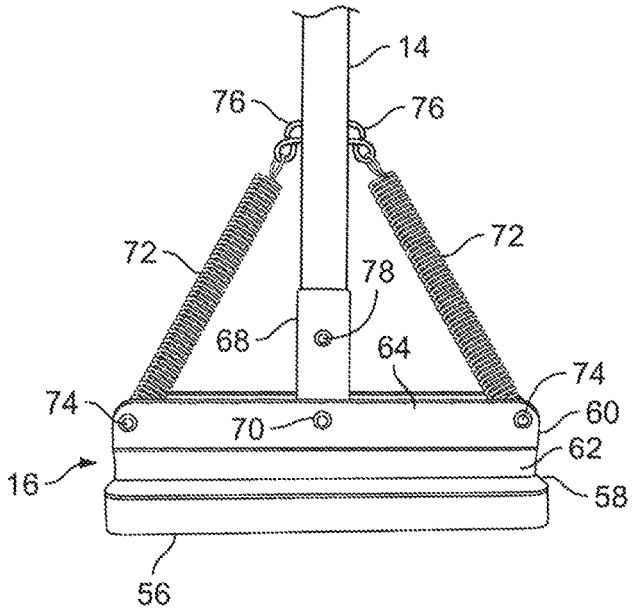
FIG. 7 is a side view of the ground engaging support of FIG. 1 showing the balanced springs in their normal position, with the skid resistant foot on the walking surface.
Figure 8:
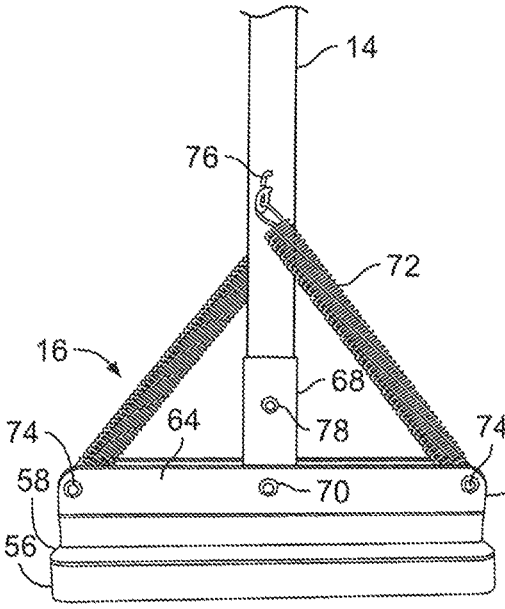
FIG. 8 is a side view of the spring loaded vertical support pivoting relative to the ground engaging support in a rotated direction while the skid resistant foot is not moved.
Figure 9:
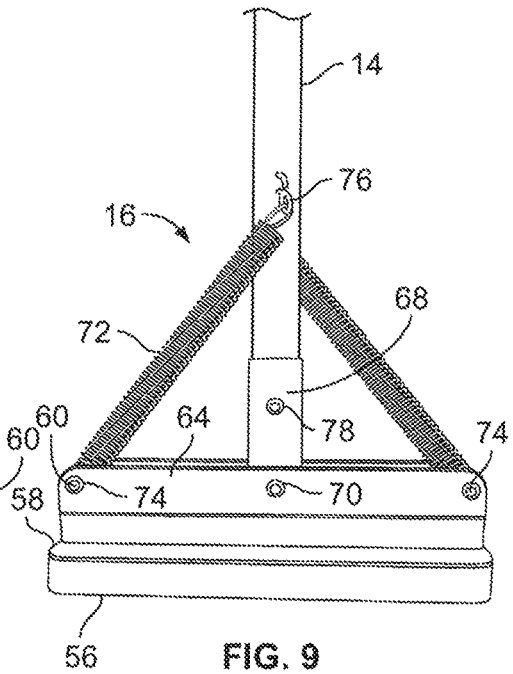
FIG. 9 is a side view of the spring loaded vertical support pivoting in a second direction without affecting the foots position relative to the ground engaging support in a second direction.

Referring to FIG. 1 and FIGS. 7-9 the ground engaging assembly 16 has a ground engaging pad 56 with a length and width sufficient to provide a skid resistance contact with the ground. The pad 56 is attached to a plate 58 by an adhesive or other means. A base 60 having a substantially U-shaped channel has a longitudinal length complementing the longitudinal length of the pad 56 and the ground engaging assembly 16. A resilient pad 62 shown in FIG. 7 is positioned between the base 60 and the plate 58 to allow limited movement and cushioning between the base 60 and the plate 58. In one embodiment, fasteners extend between the plate 58 and the base to couple the plate to the base while allowing limited movement between the plate and the base by the resilient pad 62.

The base 60 has substantially parallel side walls 64 forming an upwardly facing open longitudinal channel 66 shown in FIG. 1. A substantially tubular shaped collar 68 is connected to the base 64 for pivoting movement relative to the longitudinal dimension of the base 60. In the embodiment shown, the collar 68 is connected to the base 60 by a pivot pin 70, bolt or other fastener extending between the sidewalls 64 and through an aperture in the of the collar 68. The collar 68 is retained in the channel 66 to allow pivoting in a longitudinal direction of the channel and resisting lateral movement and resisting rotational movement about the longitudinal axis of the collar 68 with respect to the base 60. In the embodiment shown, the collar 68 has a substantially tubular configuration. In other embodiments, the collar 60 can have a suitable shape or structure to allow pivoting movement of the collar relative to the base 60 in a longitudinal dimension of the base 60.

The bottom end of the upright support 14 is received in the collar 68 whereby the upright support 14 can rotate within the collar 68 about the longitudinal axis of the upright support 14 and the longitudinal axis of the collar 68. The upright support is able to rotate about a substantially vertical axis with respect to a longitudinal dimension of the base 60. In the embodiment shown in FIGS. 7-9, a spring 72 extends from each longitudinal end of the base 60 to the upright support 14. In the embodiment show, the springs 72 retain the upright support in the collar by the spring tension while allowing rotational movement between the upright support and the collar about a vertical axis and pivoting movement of the collar relative to the base 60 about a transverse, horizontal axis relative to the longitudinal dimension of the base 60. A first end of the springs 72 is coupled to the respective longitudinal end of the base 60 by a fastener such as a pin or rivet 74 extending between the sidewalls 64 and through a hook or loop on the end of the spring. A second end of the springs 72 is connected to the upright support by a hook 76 to provide tension to the springs. The springs 72 provide sufficient tension to bias the base 62 to a rest position substantially perpendicular to the longitudinal axis of the upright support 14 and to a position where the ground engaging assembly is substantially parallel to the ground when the upright supports are positioned vertical to the ground as shown in FIGS. 7-9 and 15. The hooks 76 on the upright support 14 are preferably oriented on opposite sides of the upright support 14 to provide sufficient tension to the upright support 14 when rotated with respect to the collar 68 to bias the axial position of the upright support relative to the collar 68 and the base 62 the position shown in FIG. 7. In this manner, the spring 72 biases the angular position of the base 62 relative to the axis of the upright support 14 and the axial position of the base 62 relative to the longitudinal axis of the upright support 14. The springs 72 bias the upright support 14 to the position shown in FIGS. 7 and 15 while allowing an axial twisting or rotation of the upright support 14 to the positions shown in FIGS. 8 and 9.

In some instances, a disabled user may have a condition where either voluntary or involuntary movement of the hand or wrist occurs to rotate or twist during walking. The balance spring assembly in conjunction with the rotational movement of the upright support with respect to the collar accommodates for the rotating or twisting movement without interfering with the use of the device. The device provides the correct ergonomics and controlled rotation of the upright support with respect to the base.

During use, the underarm support assembly 12 is positioned under the arm and around the shoulder of the user so that the shoulder of the user fits snugly within the U-shaped padding of the underarm support assembly. The strap 26 can be secured over the top of the shoulder of the user to limit movement of underarm support assembly relative to the underarm of the user.

During use, the user pivots the upright support 14 in a forward direction while the underarm support remains stationary to the user where the ground engaging assembly contacts the ground. The user is then able apply substantial weight on the underarm support assembly and move forward until the upright support 14 is rearward of the user. As shown in FIGS. 2 to 4, the underarm support assembly 12 maintains a substantially fixed position relative to the user where the base 30 of the underarm support assembly remains substantially parallel to the ground while the upright support 14 pivots relative to the base 30 between the rearward position shown in FIG. 2 and the forward position shown in FIG. 4. FIGS. 2, 3 and 4 illustrate that the orthotic support and assembly remain in the same position while the vertical support moves from front to back.

The upright support 14 also pivots relative to the base 60 of the ground engaging assembly 16 during the forward movement of the upright support during use. The ground engaging assembly 16 contacts the ground to maintain the position substantially parallel to the ground while allowing the upright support 14 to pivot or rotate along the longitudinal axis of the upright support. The upright support 14 is able to pivot or rotate along the longitudinal axis of the upright support relative to the ground engaging assembly 16 by rotating within the collar 60. The springs 72 bias the upright support 14 relative to the ground engaging assembly 16 to the position shown in FIG. 7. The springs 72 to allow rotational movement of the upright support relative to the collar 60 and bias at the upright support to the rest position shown in FIG. 1.

In the embodiment shown, the collar 68 can be provided with an aperture extending transversely through the collar that can be aligned with a complementing hole or aperture in the upright support 14. An optional pin 78 can be inserted in the holes in the collar and the upright support to lock the position of the upright support relative to the collar when rotational movement of the upright support relative to the collar is to be avoided. During normal use, the pin 78 is removed to enable the support to rotate within the collar 68 as discussed above.

Figure 10:
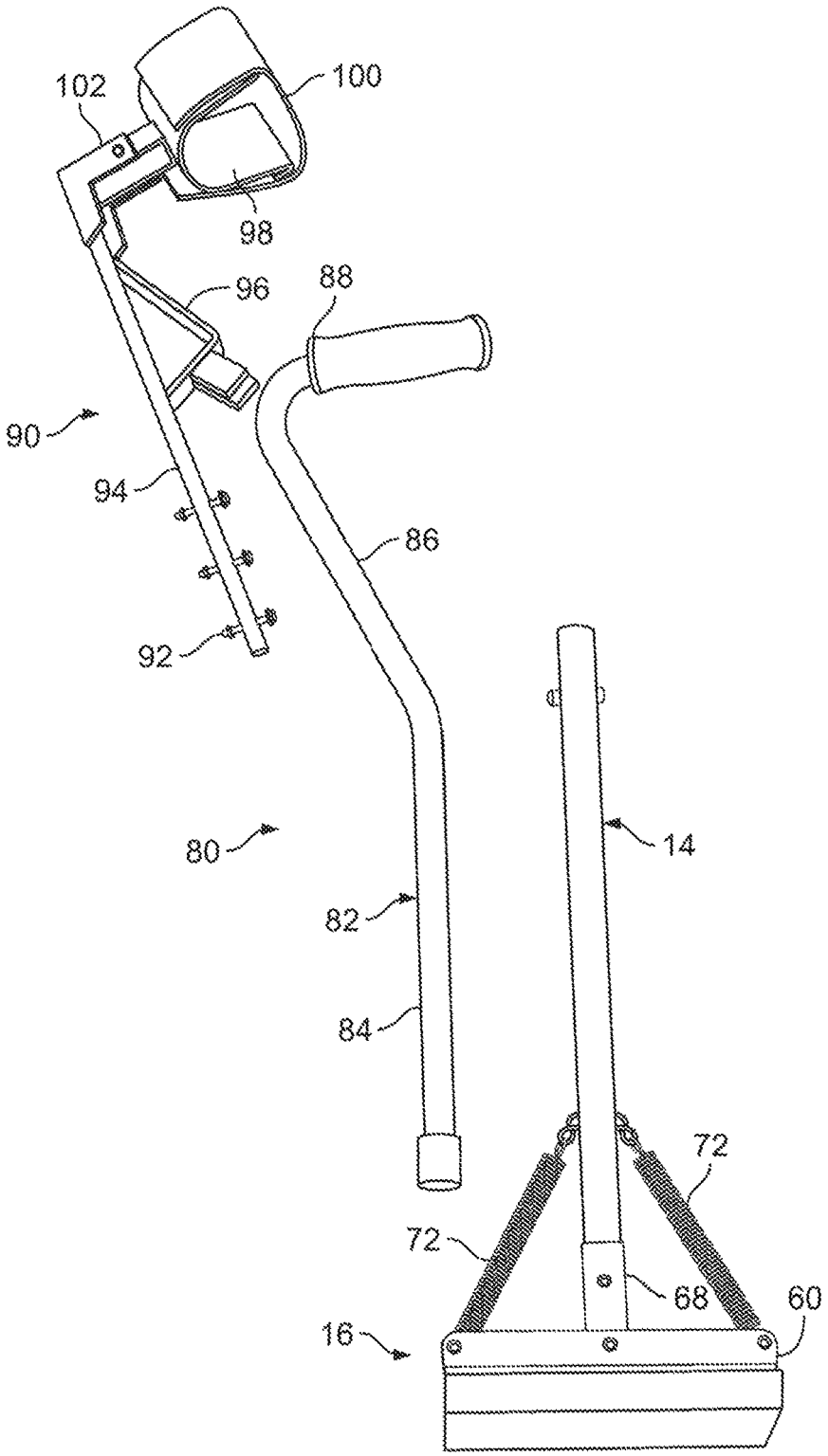
FIG. 10 is an exploded perspective view of the cane in one embodiment of the invention having a forearm cuff assembly prior to its attachment to the special designed cane.
Figure 11:
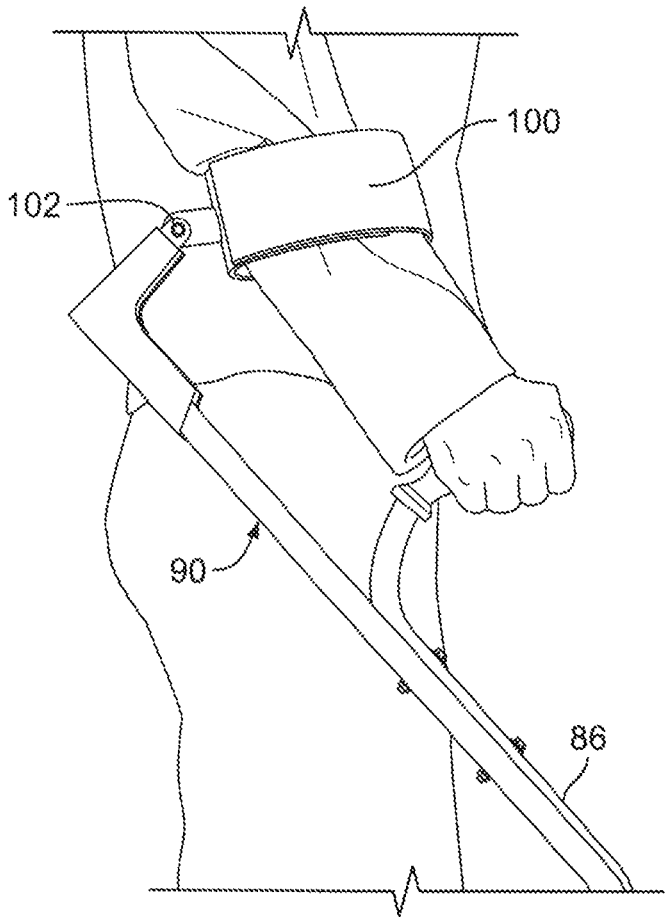
FIG. 11 is side view of the cane and forearm cuff assembly illustrating supporting the user positioned with users weight placed upon their forearm during use.

In another embodiment shown in FIG. 10 and FIG. 11, a cane assembly 80 includes an upright support and a ground engaging assembly. The ground engaging assembly is substantially the same as ground engaging assembly 16 of the previous embodiment so that the same elements are identified by the same reference number. As in the previous embodiment, an upright support 14 is connected to a collar 68 for rotational movement relative to the collar. The collar 68 is pivotally connected to the base 60 and springs 72 extend between the longitudinal ends of the base and the upright support 14 to bias the upright support relative to the ground engaging assembly.

The upright support 14 in the embodiment shown in FIG. 10 and FIG. 11 has an adjustable top section 82 that can telescope relative to the upright support 14 to adjust the length of the cane assembly 80. The top section 82 has a bottom section 84 connected to the upright support 14, an angled midsection 86 and a hand grip 88. In one embodiment, the angle between the midsection and the bottom section is about 20 degrees to provide proper support of the user's weight on the forearm cuff rather than the hand or wrists. The forearm cuff assembly 90 is connected to the angled midsection 86 by fasteners 92. The forearm cuff assembly includes a main support 94 having a linear dimension to extend in a plane substantially parallel to the longitudinal dimension of the midsection 86. A bracket 96 is provided on the support 94 to engage the top section 82 of the cane assembly to provide additional support. An angled bracket 96 is provided at the end of the main support 94 for connecting to a forearm cuff 98 having a substantially U-shape to engage the forearm of the user. A strap 100 can be provided on the cuff 98 to wrap around the users forearm. The cuff 98 is pivotally connected to the angle bracket 96 by a bolt 102, screw or pivot pin.

Figure 16:
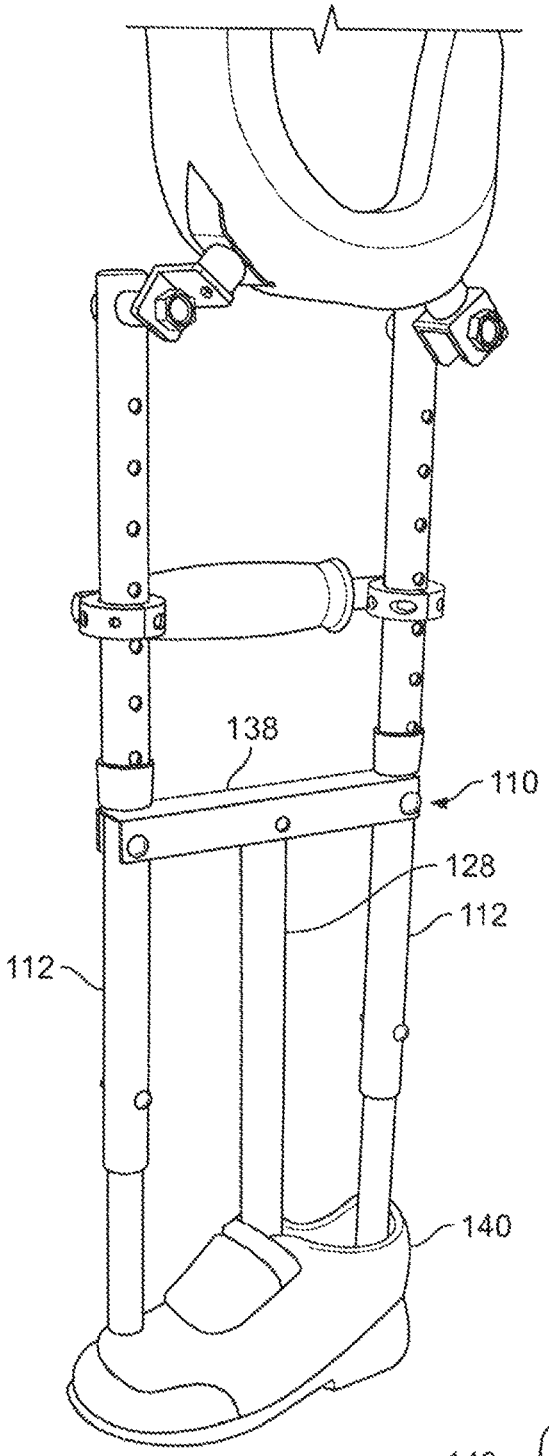
FIG. 16 is a perspective view of the orthotic device in another embodiment of the invention showing a configuration that is user friendly and less medical looking in appearance.

In another embodiment shown in FIGS. 12, 13, 14 and 16, the orthotic device 110 of the invention includes two substantially parallel upright support tubes 112 rather than the single support tube of FIG. 1. In this embodiment, the support tubes 112 are pivotally connected to the underarm support assembly in a manner similar to the previous embodiment or as shown in FIG. 16. The two parallel upright support tubes maintain the underarm support assembly and the ground engaging assembly substantially parallel to each other during movement and use. The underarm support assembly can be as in the embodiment of FIG. 1 or as shown in FIG. 16.

The ground engaging assembly 114 is similar to the ground engaging assembly of FIG. 1 except for accommodating the two upright support tubes 112. The ground engaging assembly 114 includes a base 116 having a substantially U-shape defined by a bottom wall and two upright side walls 118 spaced apart a distance to define an upwardly open channel to receive the upright support tubes 112. The two upright support tubes 112 are pivotally connected to opposite longitudinal ends of the base 116 to enable pivoting relative to base by pivot pins or rivets in a manner substantially the same as described in U.S. Pat. No. 6,164,305 which is hereby incorporated by reference in its entirety. The top ends of the upright support tubes are pivotally connected to the underarm support to enable the ground engaging assembly to pivot relative the underarm support.

Figure 12:
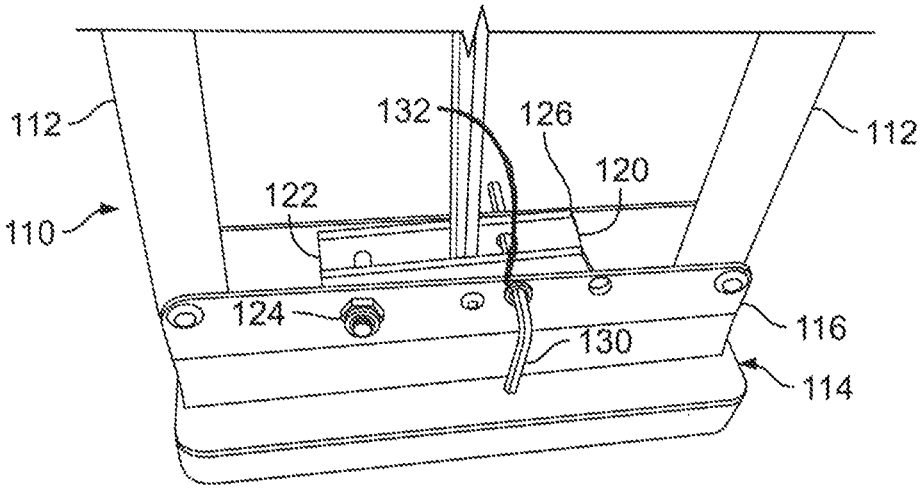
FIG. 12 is an enlarged perspective view of the orthotic device in another embodiment of the invention showing the energy conservation spring mechanism locked in place.
Figure 13:
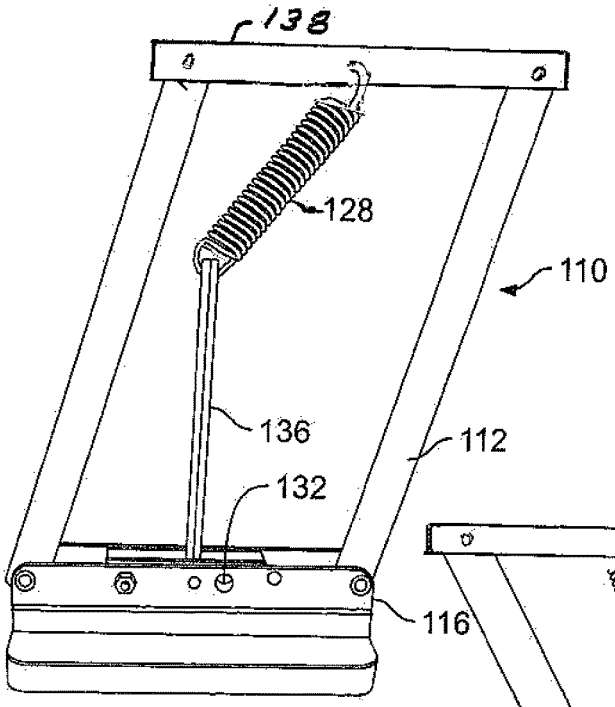
FIG. 13 is a perspective view of the ground engaging support of FIG. 12 showing the energy conservation spring mechanism unlocked and pivoted forward enabling the spring to be placed in tension relative to the ground engaging assembly.
Figure 14:
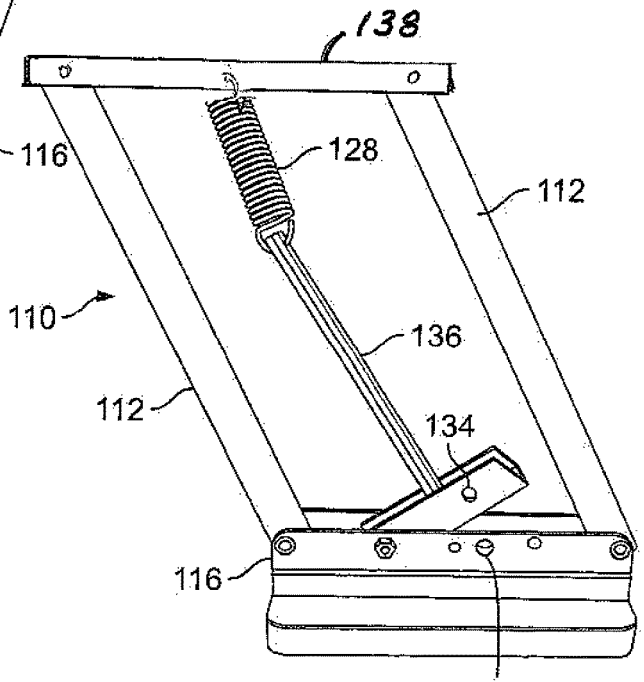
FIG. 14 is a perspective view of the ground engaging support of FIG. 12 showing the energy conservation spring mechanism unlocked and the support members pivoted rearward relative to the ground engaging assembly relaxing the spring.
Figure 15:
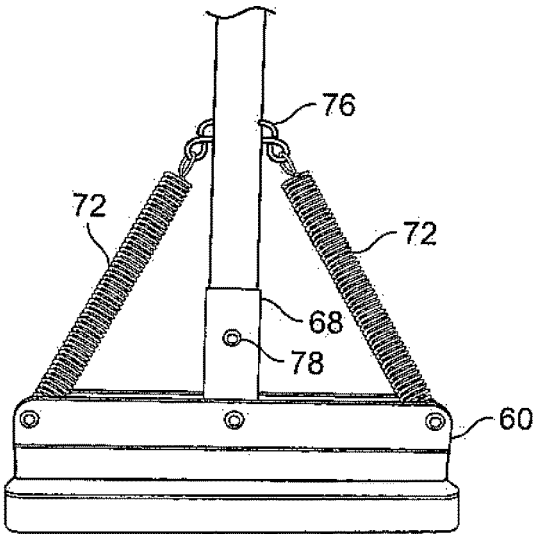
FIG. 15 is side view of the ground engaging support in another embodiment of the invention.

A mounting bracket 120 is connected to the base 116 for pivoting relative to the base 116. In the embodiment shown, the mounting bracket 120 has a longitudinal dimension that fits within the U-shaped channel of the base 116. A first longitudinal end 122 is pivotally connected to the base 116 by a pivot pin or bolt 124 as shown in FIGS. 12-14. The second free end 126 opposite the first end 122 is able to contact the base as shown in FIG. 13 and to pivot and move outwardly from the base as shown in FIG. 14.

A spring 128 extends between the cross member 138 shown in FIG. 16 of the upright support tubes 112 and the mounting bracket 120 at a location spaced from the pivot axis defined by the pin 124 of the mounting bracket 120 to the base 116. In the embodiment shown in FIG. 12, a locking member can be included to prevent pivoting of the mounting bracket 120 relative to the base 116. The locking member can be a removable pin 130 inserted through aligned holes 132 in the base 116 and holes 134 in the mounting bracket 120 as shown in FIG. 14. In the embodiment shown, a rigid member, such as a bar or rod 136 is fixed to the mounting bracket 120 and extends from the mounting bracket in a direction substantially perpendicular to the longitudinal dimension of the base. As shown, the spring 128 extends between the distal end of the rod 136 and the cross member 138.

During use of the device of FIGS. 12-14, the mounting bracket 120 is tensioned by the spring 128 to pivot upward relative to the base 120 at a rest position. In the rest position, the spring 128 biases the upright support tubes to a position substantially perpendicular to the longitudinal dimension of the ground engaging assembly and the base 116 where the mounting bracket 120 is pivoted upward from the base 116 to relieve some of the spring tension. During use, as the user moves forward of the ground engaging assembly as depicted in FIG. 13, the mounting bracket 120 contacts the bottom wall of the base 116 to a position parallel with the bottom wall and the spring applies an increased tension to bias the base 116 to the rest position. As the user moves the ground engaging assembly forward of the user to place the ground engaging assembly on the ground or walking surface as shown in FIG. 14, the mounting bracket 120 pivots away from the base 116 to reduce the spring tension thereby requiring less force by the user to firmly position the ground engaging assembly on the ground while allowing the spring to return the ground engaging assembly to the rest position when lifted from the ground.

Figure 17:
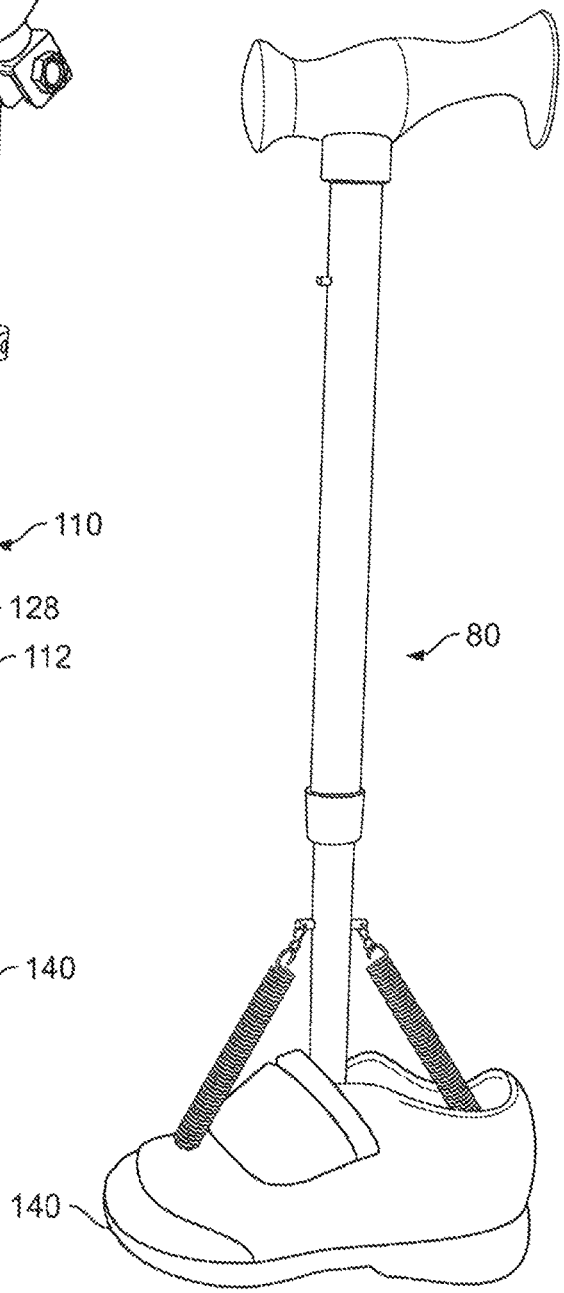
FIG. 17 is a perspective view of the cane in another embodiment the invention showing a configuration that is user friendly and less medical looking in appearance.

In another embodiment, the orthotic device can include a decorative element such as the appearance of a shoe 140 as shown in FIGS. 16 and 17. The devices of FIGS. 16 and 17 operate in a manner similar to the previous embodiments.

Figure 18:
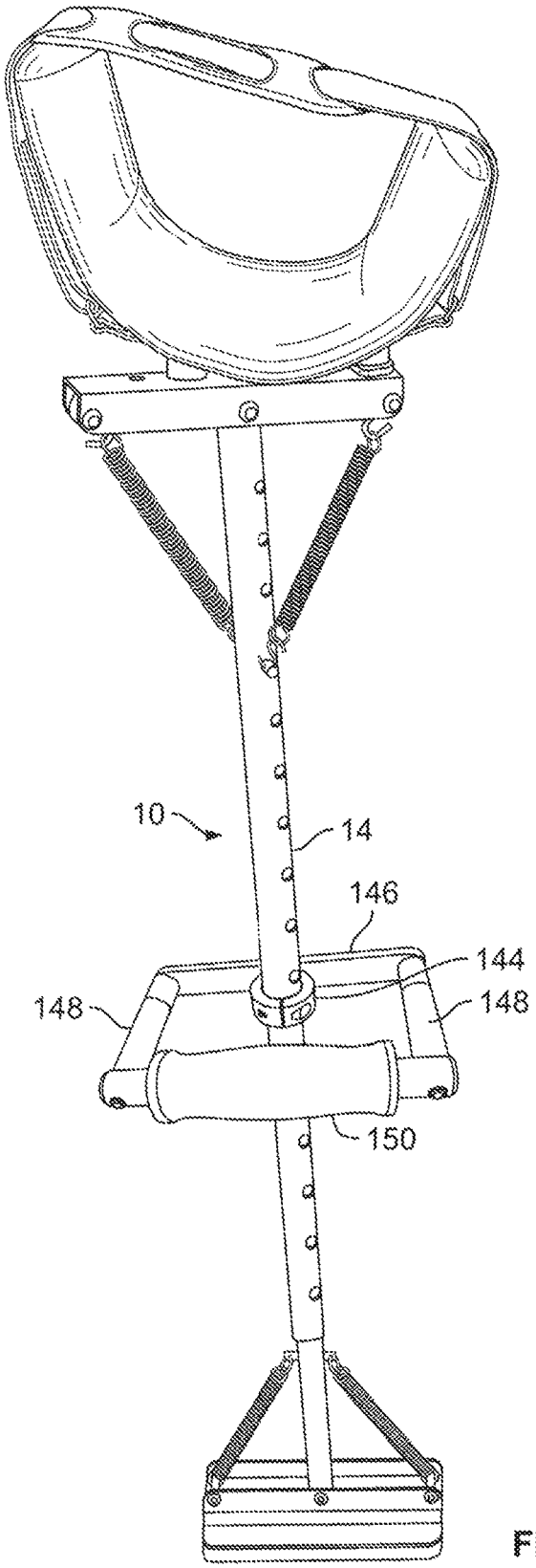
FIG. 18 is a perspective view of the orthotic device in a further embodiment of the invention showing an alternative hand grip design.

In another embodiment shown in FIG. 18 the orthotic device 10 includes an adjustable hand grip assembly 142 connected to the upright support 14. In the embodiment shown, the hand grip includes a collar 144 that can be clamped to the upright support tube 14 and adjusted along the length and at a selected angle with respect to the upright support tube. The structure and operation of the device 10 is substantially the same as in the embodiment of FIG. 1 and is not described in detail for simplicity. The hand grip includes a bar 146 is fixed to the collar 144 with the opposite ends extending outwardly from the collar. Parallel rods 148 extend outwardly from the ends of the bar 146 away from the support tube. A hand grip 150 extends between the rods 148 to be gripped by the user and space the hands outwardly from the support tube to provide a comfortable position for the user.

While various embodiments have been chosen to illustrate the invention it will be understood by those skilled in the art that various changes and modifications can be made without departing from the spirit and scope of the invention as defined in the appended claims.

What is claimed is:

1. An orthotic walking device comprising:

an underarm support assembly;

two substantially parallel upright support members having an upper end pivotally coupled to said underarm support and a cross member extending between said upright support members; and a ground engaging assembly having a base pivotally connected to a lower end of said support members, a mounting bracket having a longitudinal dimension with a first end pivotally coupled to said base and a second free end, and a spring extending between said mounting bracket and said cross member, wherein when said base is moved forward of said upright support members said mounting bracket pivots upward from said base to reduce spring tension between said ground engaging assembly and said cross member, and when said base moves rearward of said upright support members, said mounting bracket pivots to contact said ground engaging assembly and increase spring tension between said ground engaging assembly and said cross member to bias said ground engaging assembly to a predetermined position relative to said upright support members.

2. The orthotic device of claim 1, wherein said ground engaging assembly has a longitudinal dimension, and where said mounting bracket pivots between a first position substantially parallel to the longitudinal dimension of said ground engaging assembly, and a second position where said mounting bracket is at an incline relative to the longitudinal dimension of said ground engaging assembly.

3. The orthotic device of claim 2, wherein said spring extends between a midsection of said mounting bracket and said cross member.

4. The orthotic device of claim 2, wherein said mounting bracket includes a rigid member extending substantially perpendicular to said longitudinal dimension of said mounting bracket, and where said spring is coupled to a distal end of said rigid member.

5. The orthotic device of claim 4, wherein said rigid member is fixed to a midsection of said mounting bracket between said first end and said second free end.

6. The orthotic device of claim 4, wherein said mounting bracket has at least one hole aligned with at least one hole in said base of said ground engaging member, and a removable locking member received in said holes to lock said mounting bracket in a fixed position with respect to said base.

7. The orthotic device of claim 4, wherein said rigid member extends from said mounting bracket toward said cross member.

* * * * *